US009074840B2

(12) United States Patent
Andersen

(10) Patent No.: US 9,074,840 B2
(45) Date of Patent: Jul. 7, 2015

(54) CARRYING DEVICE FOR ELONGATED OBJECT

(75) Inventor: Eirik Andersen, Bones (NO)

(73) Assignee: Vorn Equipment AS, Troundheim (NO)

( * ) Notice: Subject to any disclaimer, the term of this patent is extended or adjusted under 35 U.S.C. 154(b) by 357 days.

(21) Appl. No.: 13/513,022

(22) PCT Filed: Nov. 25, 2010

(86) PCT No.: PCT/NO2010/000434

§ 371 (c)(1),
(2), (4) Date: Aug. 10, 2012

(87) PCT Pub. No.: WO2011/068414

PCT Pub. Date: Jun. 9, 2011

(65) Prior Publication Data

US 2012/0292353 A1 Nov. 22, 2012

(30) Foreign Application Priority Data

Dec. 1, 2009 (NO) ..... 20093452

(51) Int. Cl.
*F41C 33/00* (2006.01)
*A45F 3/06* (2006.01)
*F41C 33/06* (2006.01)

(52) U.S. Cl.
CPC . *F41C 33/06* (2013.01); *A45F 3/06* (2013.01); *F41C 33/005* (2013.01)

(58) Field of Classification Search
USPC ..... 224/149, 627, 645, 650, 651, 652, 247, 224/249, 250, 913
See application file for complete search history.

(56) References Cited

U.S. PATENT DOCUMENTS

| | | | | | |
|---|---|---|---|---|---|
| 3,769,741 | A | * | 11/1973 | Hessler et al. | 43/57.1 |
| 4,858,797 | A | * | 8/1989 | Rabska | 224/162 |
| 5,205,672 | A | * | 4/1993 | Stinton | 405/186 |
| 5,311,833 | A | * | 5/1994 | VanTassel et al. | 114/315 |
| 5,495,967 | A | * | 3/1996 | Parton | 224/610 |
| 5,746,361 | A | * | 5/1998 | Johnson | 224/258 |

(Continued)

FOREIGN PATENT DOCUMENTS

| | | | |
|---|---|---|---|
| DE | 102 38 155 | C1 | 11/2003 |
| FR | 2 876 785 | A1 | 4/2006 |

(Continued)

OTHER PUBLICATIONS

International Search Report from PCT/NO2010/000434 dated Mar. 25, 2011 (3 pages).

(Continued)

*Primary Examiner* — Justin Larson
(74) *Attorney, Agent, or Firm* — Osha Liang LLP

(57) ABSTRACT

The invention relates to a device (1) for carrying an elongated object (2). The device comprises a first protective layer (12) a second protective layer (14); where the respective layers (12, 14) are joined together at least at some point to form a fold (20). At least one releasable locking device (30) is provided for locking at least a part of the first protective layer (12) to at least a part of the second protective layer (14), thereby providing that the elongated object (2) may be carried between the first and second protective layer (12, 14). At least one releasing device (40) is also provided, the device (40) being connected to the releasable locking device (30), wherein activation of the releasing device (40) provides a release of the elongated object (2).

10 Claims, 6 Drawing Sheets

(56) References Cited

U.S. PATENT DOCUMENTS

| | | | | |
|---|---|---|---|---|
| 5,934,533 | A * | 8/1999 | Callanan | 224/651 |
| 6,290,114 | B1 * | 9/2001 | Berberian | 224/642 |
| 6,763,987 | B1 * | 7/2004 | Eberle | 224/637 |
| 6,851,160 | B2 * | 2/2005 | Carver | 24/197 |
| 7,654,426 | B2 * | 2/2010 | Eberle | 224/637 |
| 7,735,701 | B2 * | 6/2010 | Eberle | 224/149 |
| 8,047,413 | B2 * | 11/2011 | Arajakis | 224/577 |
| 2004/0173655 | A1 | 9/2004 | Markson | |
| 2005/0000995 | A1 * | 1/2005 | Eberle | 224/637 |
| 2006/0163304 | A1 | 7/2006 | Slesar | |
| 2007/0131728 | A1 * | 6/2007 | Arajakis | 224/257 |
| 2007/0145091 | A1 | 6/2007 | Meesey | |
| 2007/0145092 | A1 | 6/2007 | Eberle | |
| 2007/0266469 | A1 | 11/2007 | Blakeley | |
| 2010/0025446 | A1 * | 2/2010 | Eberle | 224/652 |
| 2010/0025560 | A1 * | 2/2010 | Beck | 248/558 |

FOREIGN PATENT DOCUMENTS

| | | | |
|---|---|---|---|
| NL | 2 000 496 | C2 | 8/2008 |
| WO | 01/71270 | A1 | 9/2001 |

OTHER PUBLICATIONS

Written Opinion from PCT/NO2010/000434 dated Mar. 25, 2011 (5 pages).

* cited by examiner

CARRYING DEVICE FOR ELONGATED OBJECT

FIELD OF THE INVENTION

The present invention relates to a device for carrying an elongated object and a method for production of such a device. The present invention also relates to use of such a device for carrying a long-barreled weapon.

BACKGROUND OF THE INVENTION

There exist several devices for carrying elongated objects such as long-barreled weapons, fishing rods, skateboards, snowboards, crossbows etc.

For military purposes, a primary weapon such as an automatic rifle is carried in the soldiers hands, while a secondary weapon, typically a sniper rifle, is carried on the back by means of a carrying device.

For hunting purposes, there is often a need to carry a rifle for a long distance and/or for long periods in rugged terrain before the hunter arrives in the habitat of the game. This is anatomically disadvantageous.

US 2007/0145091 describes a wearable holster for concealing a firearm on a user, comprising a quick release fastener. US 2006/0163304 describes a quick-release support strap device for carrying a weapon. None of these publications protect the weapon in a sufficient way. Moreover, they are cumbersome to use nor do they allow the facile carrying of the weapons, Eberlestock (www.eberlestock.com) is a known producer of packs for military or civilian use, comprising a primary bag with shoulder straps similar to an ordinary backpack, further comprising a secondary bag for a long-barreled weapon. Here, the weapon is carried with the weapon nozzle faced downwards and the gun-stock faced upwards. When releasing the weapon the user has to pull the weapon a substantial distance vertically up and then out from the secondary bag. This is a cumbersome operation which may take several seconds, which can be fatal in combat situations. To avoid this, the weapon must have some space in the secondary bag since it should be possible to pull it up and out. Consequently, the weapon is not fixed in relation to the pack, which may not be comfortable during long walks.

However, there is still a risk that a telescopic sight or a support of the weapon gets stuck in the fabric of the secondary bag.

The rise of the weapon high above the head of the user may cause unwanted attention.

The object of the present invention is to provide a device for carrying elongated objects, where the above disadvantages are avoided. More specific, the object of the invention is to provide a device which allows a rapid and practical release of the elongated object. Moreover, the object of the invention is to protect vulnerable parts of the elongated object towards physical impacts and/or environmental influences such as sand, snow, rain etc. Moreover the present invention presents a better manner for carrying an object over long periods of time.

According to one of the embodiments of the invention, the device provides that the weight of the elongated object 2 is distributed similarly on the users shoulder.

SUMMARY OF THE INVENTION

The present invention relates to a device for carrying an elongated object, comprising: a first protective layer and a second protective layer; where the respective layers are joined together at least at some point to form a fold; at least one releasable locking device for locking at least a part of the first protective layer to at least a part of the second protective layer, thereby providing that the elongated object may be carried between the first and second protective layer; at least one releasing device connected to the releasable locking device, wherein activation of the releasing device provides a release of the elongated object.

In one aspect, the first and second layers are joined by a third protective layer.

In one aspect, it comprises a supporting cup for supporting a lower end of the elongated object.

In one aspect, it comprises shoulder straps fixed to the first protective layer.

In one aspect, it comprises a bag fixed to the second layer.

In one aspect, it is integrated in a backpack or is fixed to a backpack.

In one aspect, the elongated object may be a weapon, a fishing rod, a skateboard, a snow board, a crossbow etc.

In one aspect, the releasable locking device comprises:

- a first connection element fastened to the first protective layer;
- a second connection element fastened to the second protective layer, where the first and second connection elements may be releaseably connected to each other by means of the releasing device.

In one aspect, the second connection element is fastened to the second protective layer via a strap element.

In one aspect, the second connection element comprises a sleeve, and where the first connection element comprises a retractable pin slidably arranged within a casing.

In one aspect, the retractable pin is biased by means of a spring arranged within the casing.

In one aspect, the releasing device comprises a handle which activates the locking device via a wire slidably arranged within a wire casing.

In one aspect, the first and/or second protective layer comprises supporting elements.

The present invention also relates to using the above device for carrying a long-barreled weapon.

DETAILED DESCRIPTION

Embodiments of the invention will now be described with reference to the enclosed drawings, where:

FIG. 1 illustrates an aspect of the first embodiment of the invention, where the device may be fixed to a backpack;

FIGS. 2*a* and 2*b* illustrate a perspective view and a top view respectively, of an aspect of the protective layers;

FIGS. 3*a* and 3*b* illustrate a perspective view and a top view, respectively, of another aspect of the protective layers;

FIG. 4*a*-4*c* illustrate different aspects of the protective layers;

FIRST EMBODIMENT

Figure 1:
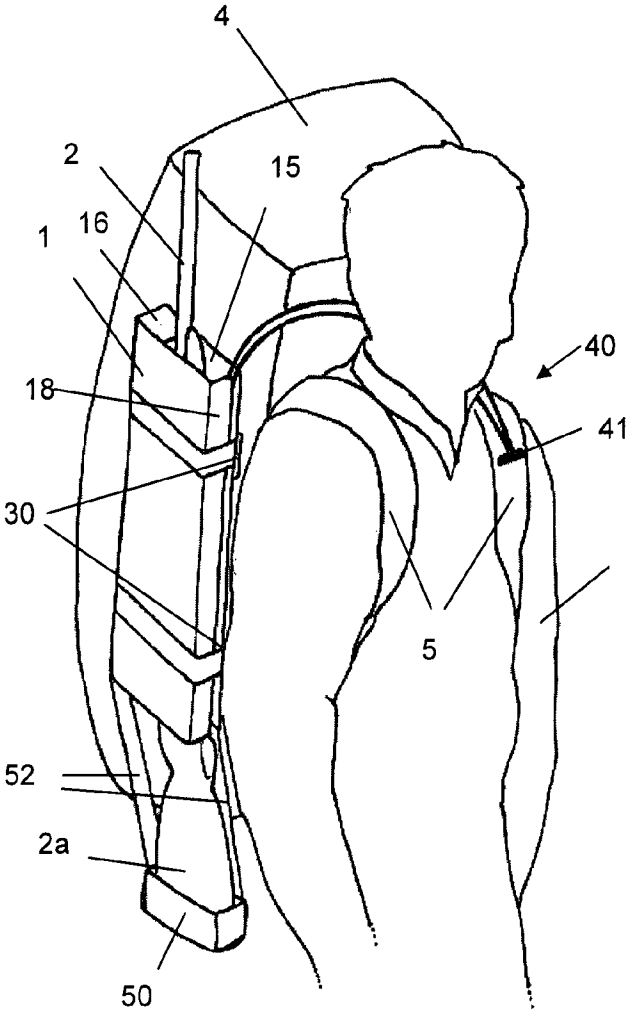

It is now referred to FIG. 1 illustrating an aspect of a first embodiment of a device 1 for carrying an elongated object 2. A user 3 is shown, wearing an ordinary backpack 4 with shoulder straps 5.

The device 1 may be fixed to the backpack 4, in FIG. 1 it is shown that the device 1 is fixed to the right side of the backpack 4, for example to a connection interface (not shown) used for side pockets for the backpack 4 or by means of separate connection means (not shown). It should be noted that the device 1 may also be fixed to the left side or to the rear side (i.e. opposite side of shoulder straps 5) of the backpack 4. Of course, it is possible to integrate the device 1 as a part of the backpack, i.e. as a special purpose side pocket.

Figure 10:
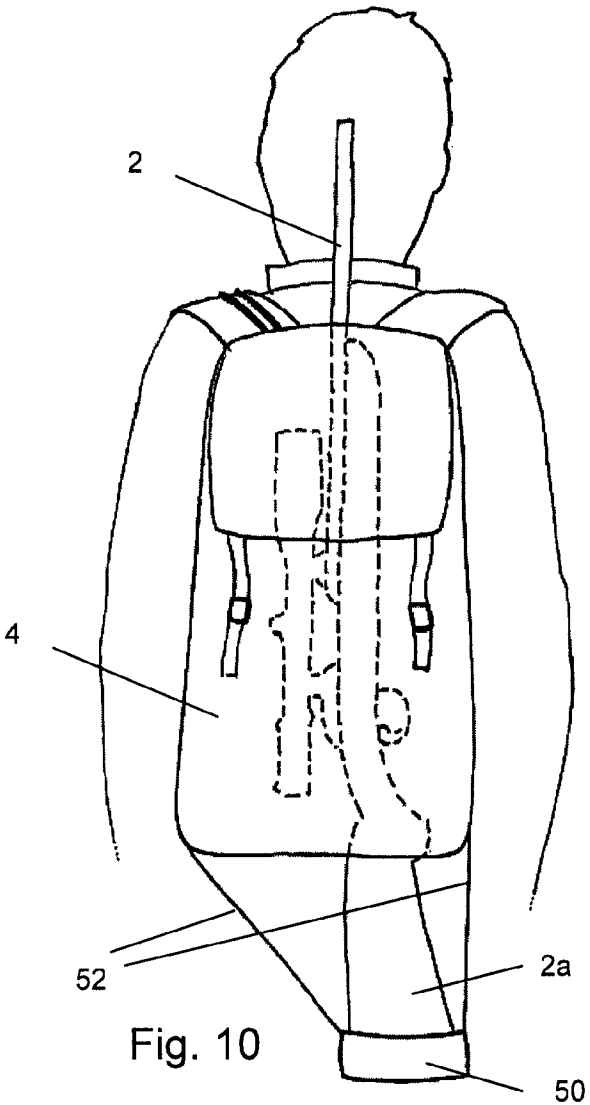
FIG. 10 illustrates a rear view of a rifle provided in the device according to the second embodiment of the invention.

The elongated object 2 is here a long-barrelled weapon, more specifically a rifle with a telescopic sight (illustrated in FIG. 10). In FIG. 1 it is shown that the barrel of the weapon is pointing upwards, while the stock 2*a* of the weapon is pointing downwards.

Figure 2A:
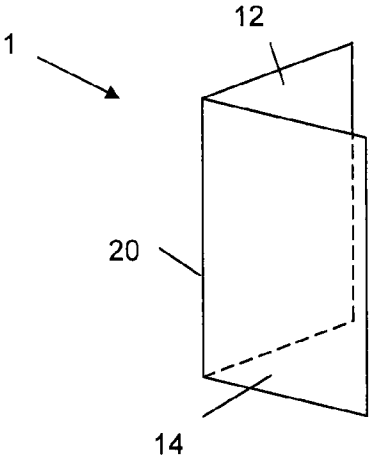
Figure 2B:
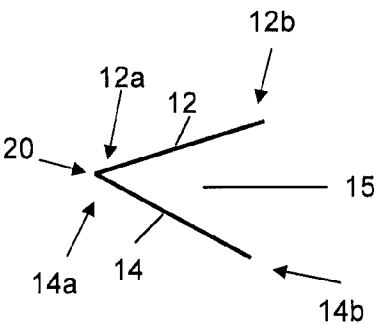

It is now referred to FIGS. 2*a* and 2*b*, illustrating the first embodiment of the invention. The device 1 for carrying the elongated object 2 comprises a first protective layer 12 and a second protective layer 14, where the respective protective layers 12, 14 are joined together at least at some point to form a fold 20.

The first protective layer 12 has a first border 12*a* and a second border 12*b* opposite of the first border 12*a*. The second protective layer 14 has a first border 14*a* and a second border 14*b* opposite of the first border 14*a*. The first borders 12*a*, 14*a* of the respective layers 12, 14 are bonded together at least at some point to form the fold 20.

The first and second protective layer 12, 14 may be provided as one sheet of a material that is folded. Alternatively, the first and second layer 12, 14 may be provided as two separate sheets of the same or different materials that are bonded together to form the fold.

The material of the first and second protective layer 12, 14 may have different properties depending on the use of the device 1. Below some desired properties are mentioned, however, the invention is not limited to such properties.

The first and second protective layer 12, 14 may be made of a robust and yet flexible material to fold around or envelope the weapon. The layers may comprise an inner shock-absorbing lining (not shown) to improve the protection of the weapon. The lining could be designed or even molded especially for one type of weapon and/or telescopic sight.

Moreover, the first and second protective layer 12, 14 may be made of a water-proof material.

The protective layers 12, 14 may comprise a flexible or soft fabric. In such an embodiment, the protective layers will provide protection against environmental influences such as sand, snow, rain etc, but not physical impacts. The fabric may be stretchable or non-stretchable.

Harder materials may be used to provide protection against physical impacts.

The device 1 further comprises at least one releasable locking device 30 for locking at least a part of the first protective layer 12 to at least a part of the second protective layer 14. In the embodiment shown in FIG. 1, the device 1 comprises two releasable locking devices; one upper releasable locking device and one lower releasable locking device. Thereby it is provided that the elongated object 2 may be carried between the first and second protective layer 12, 14.

The space between the first and second protective layer 12, 14 may be considered as an object compartment 15.

In the description above, the weapon is carried between the first and second protective layer 12, 14 by means of a clamping force exerted by the locking of the first protective layer 12 to the second protective layer 14 around the elongated object by means of the releasable locking device 30.

More specific, the at least one releasable locking device 30 is locking at least a part of the second border 12*b* of the first protective layer 12 to at least a part of the second border 14*b* of the second protective layer 14.

The device 1 further comprises at least one releasing device 40 connected to the releasable locking device 30, wherein activation of the releasing device 40 provides a release of the elongated object 2.

In FIG. 1 it is shown that the releasing device 40 is provided on one of the users shoulders, for example fixed to one of the shoulder straps 5, thereby providing a remote activation of the releasing device 40 in relation to the releasable locking device 30. Here, the releasing device 40 is mechanically connected to the releasable locking device 30, as will be described in detail below. Consequently, the releasing device 40 provides a remote release of the elongated object.

Figure 6:
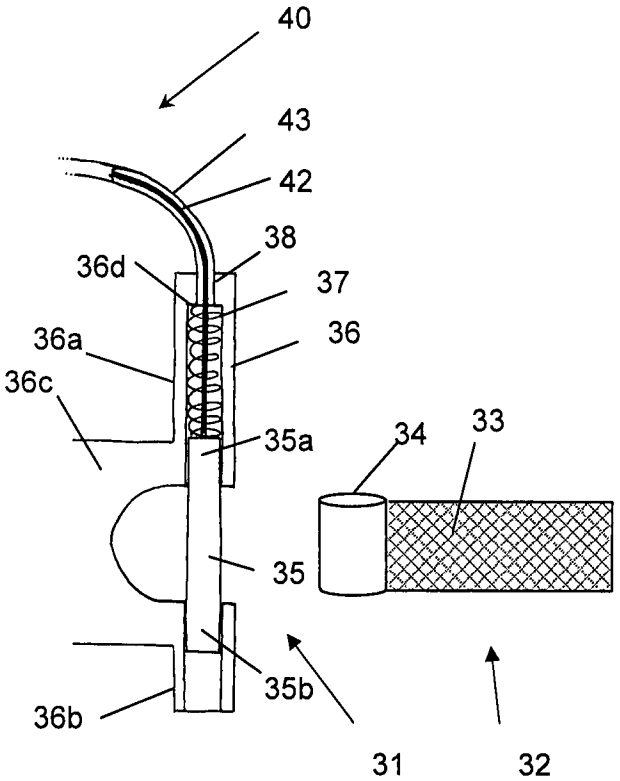
FIG. 6 illustrates the releasable locking device and parts of the releasing device.
Figure 5:
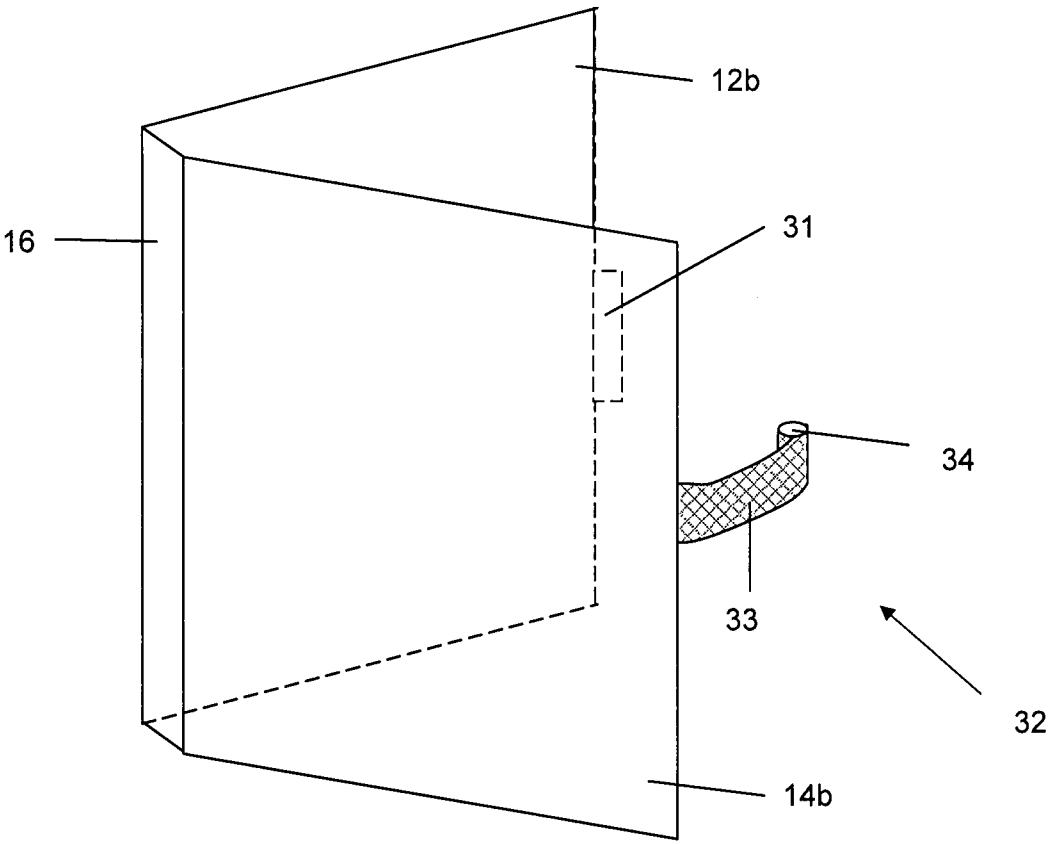
FIG. 5 illustrates the releasable locking device in relation to the protective layers.

It is now referred to FIGS. 5 and 6, showing details of the releasable locking device 30 and parts of the releasing device 40.

The releasable locking device 30 comprises a first connection element 31 and a second connection element 32. In FIG. 5 the first connection element 31 is illustrated by means of a dashed box.

The first connection element 31 is fastened to the first protective layer 12. In FIG. 5 it is shown that the first connection element is fastened to the second border 12*b* of the first protective layer 12. The second connection element 32 is fastened to the second protective layer 14. In FIG. 5 it is shown that the second connection element 32 is fastened to the second border 14*b* of the second protective layer 14. The first and second connection elements 31, 32 may be releaseably connected to each other by means of the releasing device 40.

In the present embodiment, the second connection element 32 comprises a strap element 33. A first end of the strap element 33 is fastened to the second protective layer 14. A sleeve 34 is provided in a second end of the strap element 33.

In FIG. 6 it is shown that the first connection element 31 comprises a retractable pin 35 slidably arranged within a casing 36. The retractable pin 34 is biased by means of a spring 37 arranged within the casing 36. FIG. 6 illustrates the releasable locking device 30 in its unlocked state.

The casing 36 comprises two casing sections—a first casing section 36*a* wherein the spring 37 and a first end 35*a* of the pin 35 is arranged and a second casing section 36*b* for receiving a second end 35*b* of the pin 35. The first and second casing sections 36*a*, 36*b* are spaced apart, thereby providing that the sleeve 34 of the second connection element 32 may be received in the space between the first and second casing sections 36*a*, 36*b*. It should be noted that the retractable pin 35 has an outer diameter that is smaller than the inner diameter of the sleeve 34. Hence, the second end 35*b* of the retractable pin 35 may be inserted through the sleeve 34 and further into the second casing section 36*b*, thereby locking the sleeve 34 of the second connection element 32 to the pin 35 of the first connection element 31.

As shown in FIG. 6, the first and second casing sections 36*a*, 36*b* are fixed to each other by means of a bracket element 36*c*, fastened to the first protective layer 12.

The releasing device 40 may comprise a handle 41 (shown in FIG. 1) which activates the releasable locking device 30 via a wire 42 slidably arranged within a wire casing 43. The wire is in one end connected to the handle 41 and in its other end connected to the first end 35*a* of the pin 35. As shown in FIG. 6, the spring 37 is provided around the wire 42, between an inner end surface 36*d* of the casing 36 and the first end 35*a* of the pin 35. In the inner end surface 36*d* an opening 38 is provided for the wire 42.

The wire 42 and the wire casing 43 may be flexible, allowing the first and second protective layers 12, 14 and the releasable locking device 30 to move in relation to the handle 41. Consequently, the device 1 may feel comfortable during walking, and it also provides the possibility for the user 3 to change the location of the handle 41.

The use of the device 1 will now be described. If the user 3 wants to release the weapon from the device 1, one arm is moved backwards to grasp the barrel of the object 2 protruding from the protective layers 12, 14. Then the releasing device 40 is activated by pulling the handle 41. Consequently, the pin 35 will be retracted into the first casing section 36*a* and the sleeve 34 will be released from the pin 35.

Hence, the first and second connection elements 31, 32 are no longer connected to each other, and the second protective layer 14 is free to unfold along the fold 20 thereby providing that the weapon is released from the protective layers 12, 14. The user 3 may now swing the weapon out to the side and forward, and the weapon is ready for use.

According to the above, the risk for the weapon to get stuck during the releasing operation is considerably reduced. Moreover, the weapon is released sideways—and not upwards.

When the user 3 wants to put the weapon back into the device 1, he positions the weapon in a desired way, preferably with the telescopic sight, the bolt knob and the trigger protected between the first and second protective layers 12, 14. Then he activates the handle 41 to retract the pin 35, and then positions the sleeve 34 before he releases the handle 41. The spring 37 will then force the pin through the sleeve 34 and into the second casing section 36*b*.

In the present embodiment, the user 3 will most likely need to remove the backpack 4 from the back to position the sleeve 34 in relation to the pin 35. Alternatively, other persons may help with this operation.

Aspects of the First Embodiment

There are several alternative aspects of the first embodiment, which will be described in detail below.

In the first embodiment above, the device 1 may carry the weight of the elongated weapon alone when the weapon is locked between the first and second protective layer 12, 14 by means of the releasable locking device 30. However, the device 1 may also comprise a supporting cup 50 for supporting a lower end or stock 2*a* of the elongated object 2. The supporting cup 50 may be adapted to the form of the stock 2*a*. In FIG. 1, it is shown that the supporting cup is fastened to the first and/or second protective layer 12, 14 by means of a strap 52. Consequently, at least parts of the weight of the object 2 may be carried by the supporting cup 50.

Figure 3A:
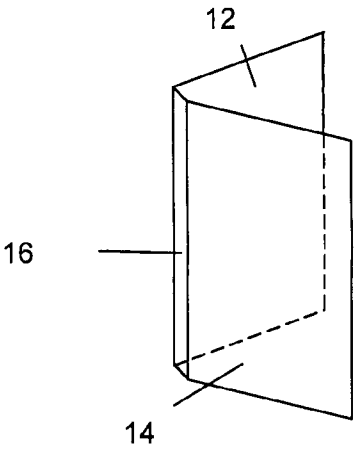
Figure 3B:
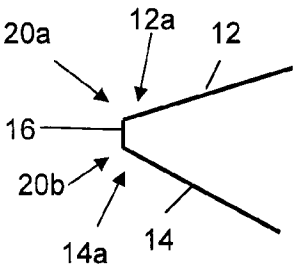

It is now referred to FIGS. 3*a* and 3*b*. Here it is shown that the first and second protective layers 12, 14 are joined by a third protective layer 16. More specific, the first border 12*a* of the first protective layer 12 is bonded to a first border of the third layer 16 and a second border of the third layer 16 being opposite of the first border may be bonded to the first border 14*a* of the second layer 14. Hence, the first protective layer 12 is joined together with the third layer 16 at least at some point to form a fold 20*a*, and the second protective layer 14 is joined together with the third protective layer 16 at least at some point to form a fold 20*b*. It should be noted that it would be possible to fasten a supporting cup 50 also to this aspect of the first embodiment.

Figure 4C:
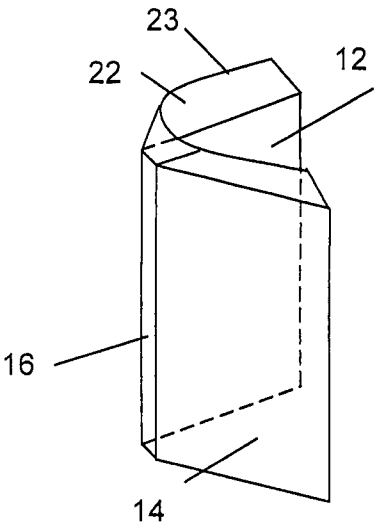
Figure 4B:
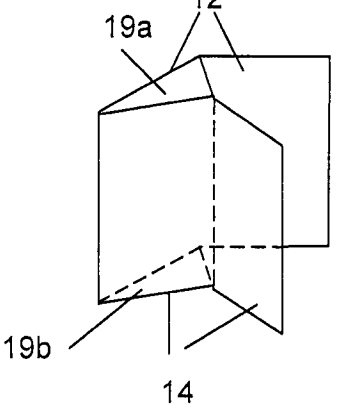
Figure 4A:
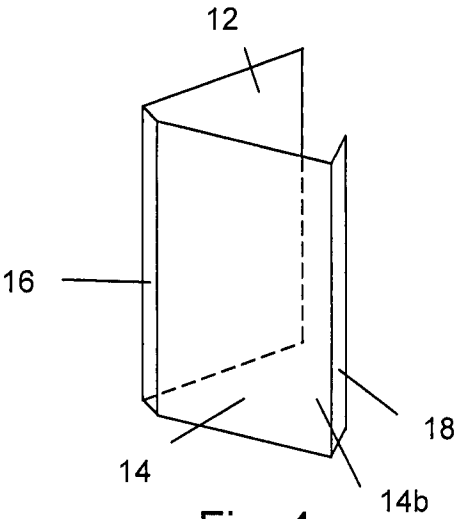

It is now referred to FIG. 4*a*. Here it is shown a device similar to the one shown in FIGS. 3*a* and 3*b*, i.e. comprising a third protective layer 16. In addition, this aspect of the first embodiment comprises a fourth protective layer 18 joined to the second border 14*b* of the second protective layer 14. In its closed state, i.e. when the elongated object is locked between the first and protective layer 12, 14 by locking of the releasable locking device 30, the fourth protective layer 18 is configured to be close to the second border 12*a* of the first protective layer 12. The fourth protective layer 18 may even lie against the second border 12*a*, for protecting the object 2 from all sides. FIG. 1 also shows this aspect of the first embodiment. It should be noted that it would be possible to fasten a supporting cup 50 also to this aspect of the first embodiment.

It is now referred to FIG. 4*b*. Here it is shown a device similar to FIGS. 2*a* and 2*b*. However, here also upper and lower borders of the first and second protective layers 12, 14 are at least partially joined. In FIG. 4*b* it is shown that the upper and lower borders of the first and second protective layers 12, 14 are partially joined by means of fifth protective layers 19*a*, 19*b* respectively.

It should be noted that in the embodiments above, the protective layers 12, 14 have a substantially rectangular shape. However, it may be possible to provide these layers with several different shapes, such as triangular or polygonal. The protective layers may also be shaped to form a volume.

It is now referred to FIG. 4*c*. Here it is shown a device similar to FIGS. 3*a* and 3*b* above. Here, also the upper border of first, second and third layers 12, 14, 16 are at least partially bonded by means of an upper protective layer 22. The upper protective layer 22 is here a flexible fabric with an elastic band 23 provided in its upper edge. The elastic band 23 may be pre-tensioned. Hence, the elastic band 23 will tighten around the upwardly protruding part of the elongated object 2 when in its closed state, thereby providing a protection towards snow, rain, sand etc. The upper protective layer 22 will not obstruct the release of the object during release of the releasable locking device 30. The upper protective layer 22 may be sufficiently large to cover the entire upper part of the elongated object, for example the entire barrel of the weapon.

It should be noted that this aspect of the invention may be combined with several of the other aspects above, for example with the supporting cup 50 of FIG. 1, with the fourth protective layer 18 of FIG. 4*a* etc.

In an alternative embodiment, the lower border of first, second and third layers 12, 14, 16 may be at least partially bonded by means a lower protective layer (not shown), for protecting the lower part of the elongated object at least partially. The lower protective layer may also provide an elastic band for tightening around the elongated object. The function of the supporting cup 50 may then be provided by means of this lower protective layer. Alternatively, the supporting cup 50 may be provided inside the lower protective layer.

Hence, by providing the device 1 with both a sufficiently large upper protective layer 18 and a sufficiently large lower protective layer, the entire elongated object may be protected.

Figure 8:
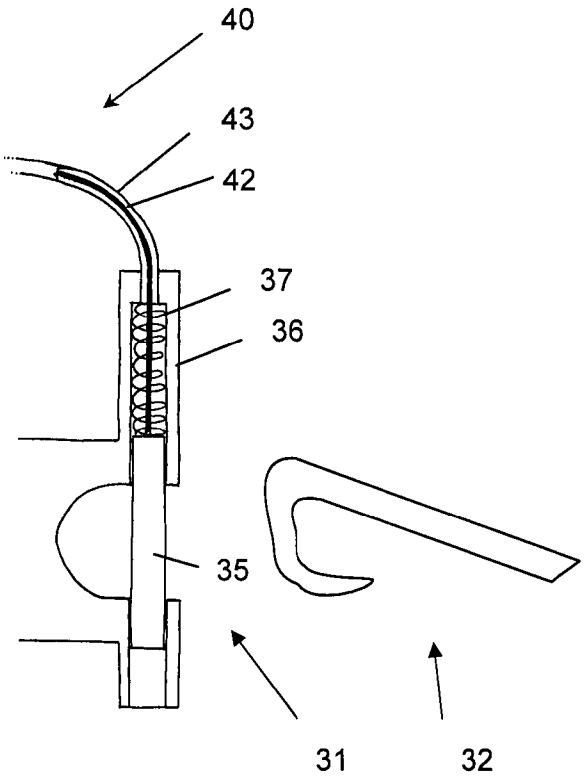
FIGS. 7 and 8 illustrate an aspect of the releasable locking device of FIGS. 5 and 6.
Figure 7:
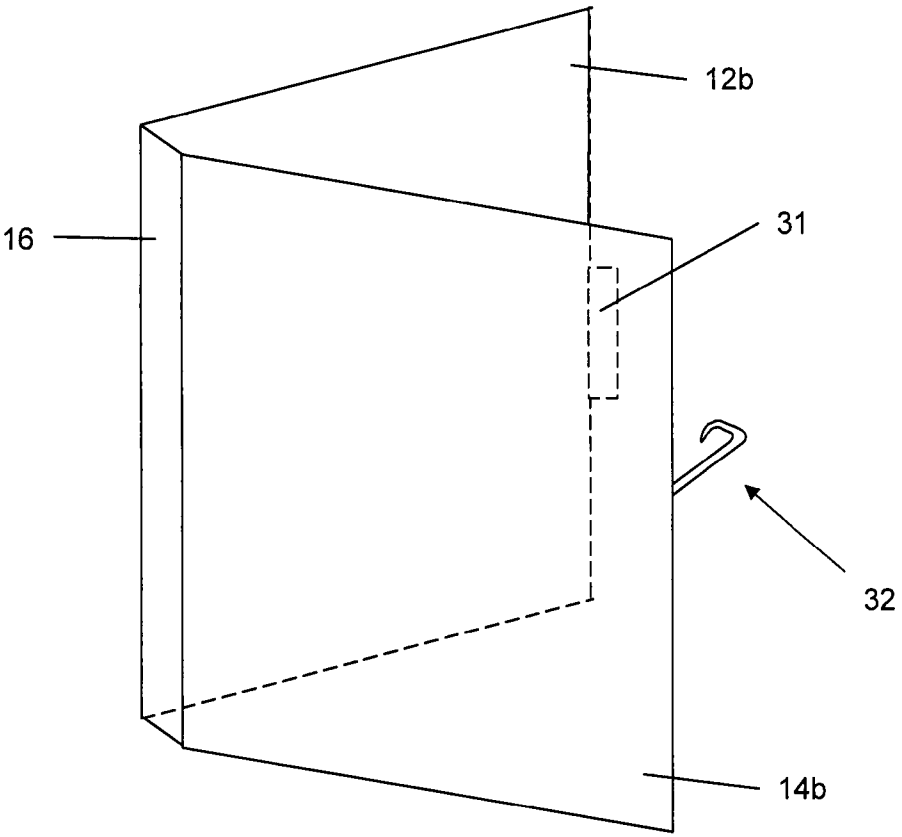

It is now referred to FIGS. 7 and 8 illustrating an alternative aspect to the releasable locking device 30. Here, the first connection element 31 is corresponding to the first connection element 31 described above with reference to FIG. 6. The second connection element 32 comprises a hook device adapted to receive the pin 35. The release of the connection elements 31, 32 will be as described with reference to FIG. 6. However, the hook device may have some flexibility, thereby allowing the hook device to be hooked around the pin 35. Consequently, there is no need to retract the pin 35 by means of handle 41 to connect the first and second connection element 31, 32 together. It should be noted that the hook device should be sufficiently rigid to prevent accidental disconnection of the hook device from the pin 35.

The hook device might be directly fixed to the second border 14*b* of the second protective layer, it may be movably connected to the second border 14*b* of the second protective layer 14, for example by a rotatable connection element such as a hinge connection, or it might be connected to the second border 14*b* of the second protective layer 14 by means of a strap element 33 as in FIG. 6.

In FIG. 1, the device 1 is fastened to a backpack 4 having shoulder straps 5. However, the device 1 itself may comprise shoulder straps 5 fixed to the first protective layer 12. Here, the user 3 will only carry the object 2 on the back. Moreover, it would be possible to fix a bag to the second protective layer 14, the bag being used to carry other items. It should be noted that it would be possible to combine this aspect with the other aspects described above, i.e. the one described with reference to FIG. 2*a*, 3*a*, 4*a*-c.

Second Embodiment

It is now referred to FIGS. 9-13, illustrating a second embodiment of the invention. In the second embodiment, the device 1 is integrated into a backpack.

Figure 9:
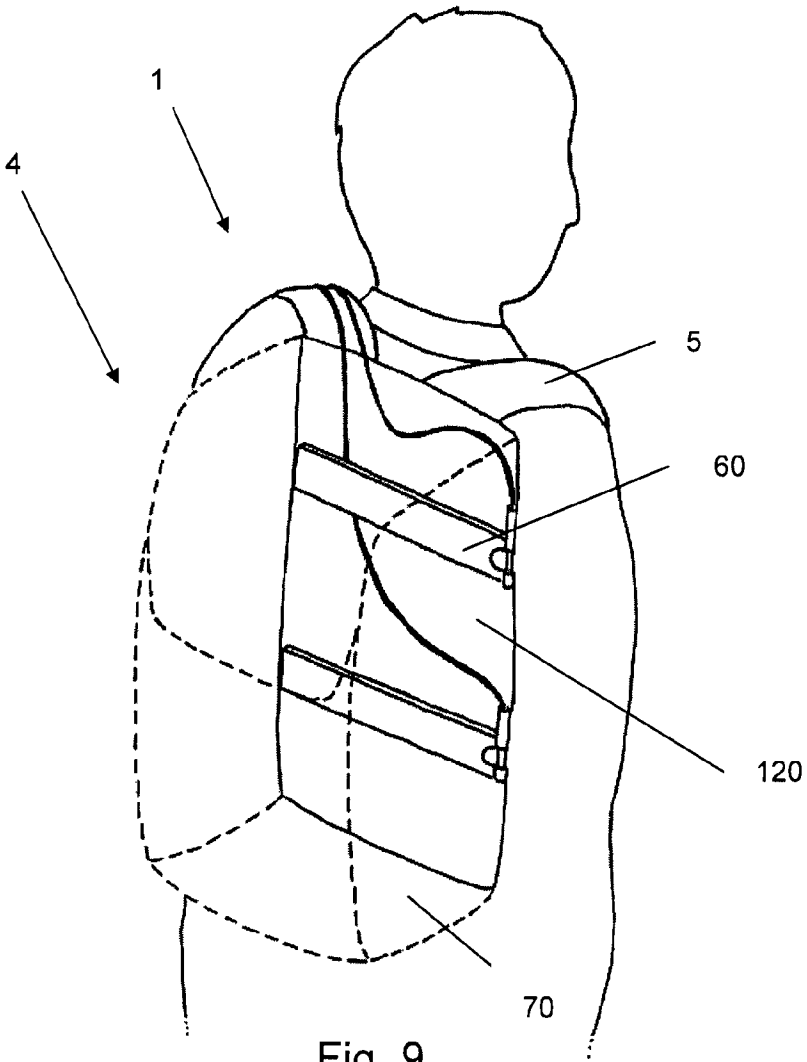
FIG. 9 illustrates a perspective view of the releasing device and parts of the releasable locking device of a second embodiment of the invention, where the device is incorporated in a backpack

In FIG. 9, it is shown that the first protective layer 12 is formed as a back surface 120 of a backpack 4. It should be noted that the term "back surface" here indicates the surface of the backpack 4 towards the users back.

The back surface 120 may itself be made of a flexible material connected to rigid supporting elements 60. In FIG. 9 it is shown that the device 1 comprises two rigid supporting elements 60, where first connection elements 31 is fixed to respective ends of the supporting elements. This can also be seen in FIGS. 6 and 8, where the bracket element 36*c* of the casing 36 is a part of the supporting element 60.

In FIG. 10 it is shown how an object 2, here a long barreled weapon, is carried in the device 1. The outline of the weapon is indicated through the backpack 4 by use of dashed lines. It is also shown that the lower end 2*a*, i.e. the stock, of the weapon is supported by the supporting cup 50 fastened to the backpack or to the back surface 120 by means of the strap elements 52.

Figure 11:
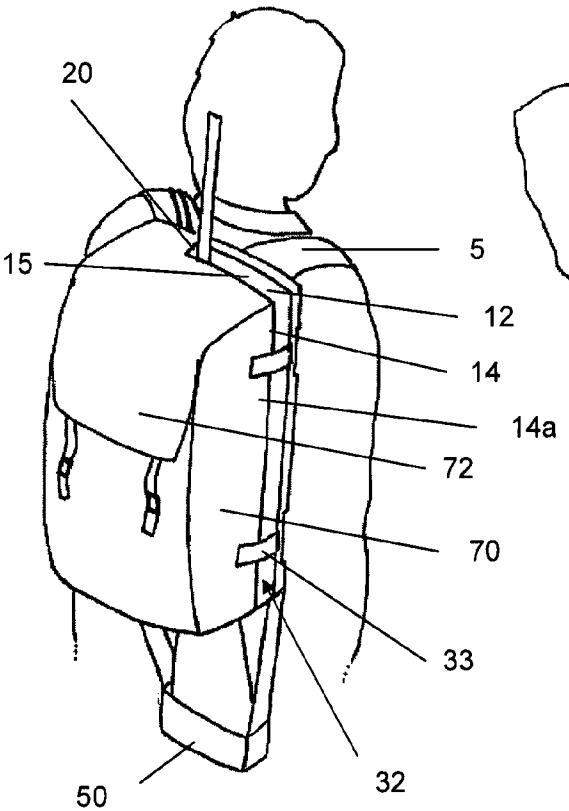

It is now referred to FIG. 11. Also here it is shown that the device 1 for carrying the elongated object 2 comprises a first protective layer 12 and a second protective layer 14, where the respective layers 12, 14 are joined together at least at some point to form a fold 20. The protective layers 12, 14 are joined along their first borders 12*a*, 14*a* and also partially along their upper and lower borders, in a similar way as the device 1 described with reference to FIG. 4*b* above. Consequently, the object compartment 15 between the protective layers 12, 14 appears as a substantially vertical slit in the backpack 4.

The second protective layer 14 is fixed to a bag 70. The bag 70 may be used to carry other items. As known for a skilled person, the bag may have an upper opening, which may be closed by means of a lid 72.

In FIG. 11, it is also shown that the second connection element 32 comprises a strap element 33 fastened to the second border 14*a* of the second protective layer 14. When the strap elements 33 and the sleeve 34 (alternatively the hook device) is locked to the first connection device 31, the second protective layer 14 is forced towards the first protective layer 12, thereby clamping the object 2 between the first and second protective layer 12, 14. Consequently, it is provided that the elongated object 2 may be carried between the first and second protective layers 12, 14.

Figure 12:
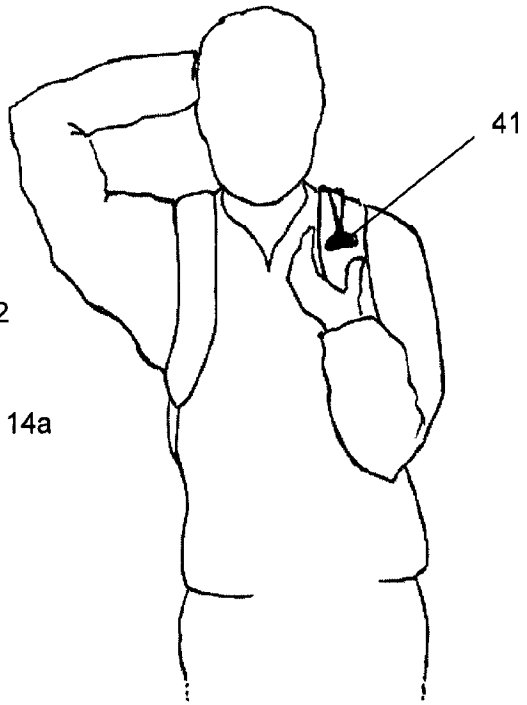

In FIG. 12, the user 3 uses one hand to grasp the upper end of the object, the barrel of the weapon, while the other hand is used to activate the handle 41.

Figure 13:
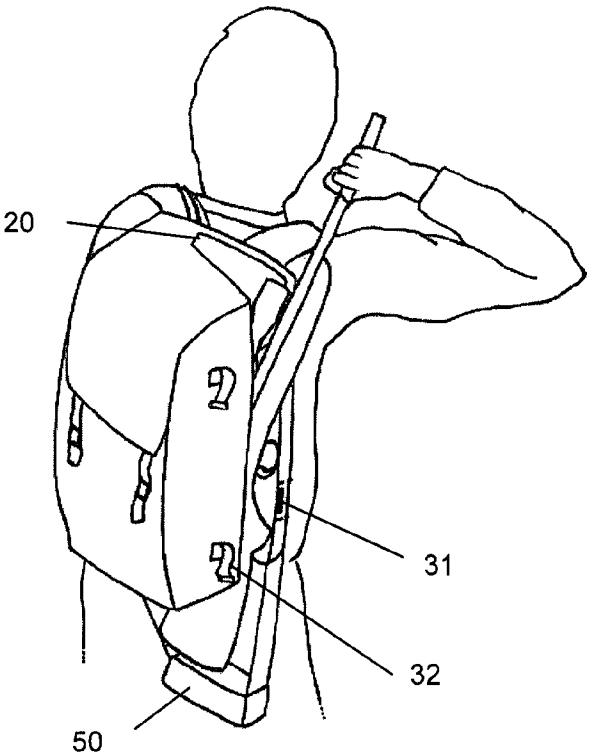
FIGS. 11-13 illustrate the steps of releasing an object from the device according to the second embodiment.

In FIG. 13 it is shown that the releasable locking device 30 is released, i.e. the second connection element 32 is disconnected from the first connection element 31. The user 3 now moves the object sideways out from the slit or compartment 15, without any obstacles.

In the second embodiment, the second protective layer 14 may be formed by the bag 70 itself, i.e. the second protective layer 14 forms a separation wall between the compartment of the bag 70 and the compartment 15 for the object 2. Consequently, the bag 70 will form a protection of the object 2.

In the description above, the elongated object 2 is a long-barrelled weapon, such as a rifle, a shotgun etc. However, the object 2 may also be a fishing rod, a skateboard, a crossbow, a snowboard etc.

The device according to the present invention may also be used as a pistol holster or the like, for carrying a pistol or other hand weapons.

The invention claimed is:

1. A device for carrying a long-barreled weapon, comprising:

a first protective layer;

a second protective layer, wherein the respective layers are joined together at least at some point to form a fold;

at least one releasable locking device for locking at least a part of the first protective layer to at least a part of the second protective layer, such that the long-barreled weapon may be carried between the first and second protective layer, the at least one releasable locking device comprising a first connection element fastened to the first protective layer and a second connection element fastened to the second protective layer; and at least one releasing device connected to the releasable locking device, wherein the at least one releasing device is mechanically connected to the releasable locking device and wherein activation of the at least one releasing device provides a remote release of the long-barreled weapon, wherein the at least one releasing device connects the first and second connection elements to each other, wherein the device is integrated in or a backpack, wherein the long-barreled weapon is carried between the first and second protective layer by a clamping force exerted by locking of the first protective layer to the second protective layer around the long-barreled weapon by the releasable locking device, and wherein the first protective layer is a back surface of the backpack corresponding to a surface of the backpack facing toward a back of a user.

2. The device according to claim 1, wherein the first and second protective layers are joined by a third protective layer.

3. The device according to claim 1, wherein the device comprises a supporting cup for supporting a lower end of the long-barreled weapon.

4. The device according to claim 1, wherein the device comprises a plurality of shoulder straps fixed to the first protective layer.

5. The device according to claim 4, wherein the device comprises a bag fixed to the second layer.

6. The device according to claim 1, wherein the second connection element is fastened to the second protective layer via a strap element.

7. The device according to claim 1, wherein the second connection element comprises a sleeve, and wherein the at least one releasing device comprises a retractable pin slidably arranged within a casing.

8. The device according to the claim 7, wherein the retractable pin is biased by means of a spring arranged within the casing.

9. The device according to claim 1, wherein the releasing device comprises a handle which activates the locking device via a wire slidably arranged within a wire casing.

10. The device according to claim 1, wherein the first or second protective layer comprises a plurality of supporting elements.

* * * * *